US007316141B2

(12) United States Patent
Goldman

(10) Patent No.: US 7,316,141 B2
(45) Date of Patent: Jan. 8, 2008

(54) ELECTRONIC LOCKING MECHANISM AND LOCK CONTAINING IT

(76) Inventor: Ilan Goldman, 3 Hayasmin Street, Herzliya 46631 (IL)

( * ) Notice: Subject to any disclaimer, the term of this patent is extended or adjusted under 35 U.S.C. 154(b) by 74 days.

(21) Appl. No.: 10/547,743

(22) PCT Filed: Mar. 7, 2004

(86) PCT No.: PCT/IL2004/000226

§ 371 (c)(1),
(2), (4) Date: Sep. 2, 2005

(87) PCT Pub. No.: WO2004/079136

PCT Pub. Date: Sep. 16, 2004

(65) Prior Publication Data

US 2006/0179903 A1 Aug. 17, 2006

(30) Foreign Application Priority Data

Mar. 6, 2003 (IL) ..... 154788

(51) Int. Cl.
*E05B 49/00* (2006.01)

(52) U.S. Cl. ..... 70/278.7; 70/275; 70/277

(58) Field of Classification Search ..... 70/20, 70/31, 35, 38 R, 38 A, 39, 275, 277, 278.7
See application file for complete search history.

(56) References Cited

U.S. PATENT DOCUMENTS

| | | | | |
|---|---|---|---|---|
| 3,974,669 | A * | 8/1976 | Stackhouse | 70/276 |
| 4,949,564 | A | 8/1990 | Barzilai | |
| 5,090,222 | A | 2/1992 | Imran | |
| 5,216,909 | A * | 6/1993 | Armoogam | 70/278.7 |
| 5,307,656 | A * | 5/1994 | Gartner et al. | 70/277 |
| 5,386,713 | A * | 2/1995 | Wilson | 70/280 |
| 5,406,812 | A | 4/1995 | Jaw | |
| 6,384,711 | B1 * | 5/2002 | Cregger et al. | 70/277 |
| 6,411,195 | B1 | 6/2002 | Goldman | |
| 6,434,985 | B1 * | 8/2002 | Walmsley | 70/277 |
| 6,792,779 | B1 * | 9/2004 | Shen | 70/38 B |
| 6,826,935 | B2 * | 12/2004 | Gokcebay et al. | 70/277 |
| 6,993,943 | B1 * | 2/2006 | Chang | 70/38 B |
| 7,076,976 | B1 * | 7/2006 | Goldman | 70/38 A |

FOREIGN PATENT DOCUMENTS

| | | |
|---|---|---|
| EP | 0 668 422 A1 | 8/1995 |
| EP | 0 761 921 A1 | 3/1997 |
| EP | 1 180 744 A1 | 2/2002 |
| WO | 90/15910 A1 | 12/1990 |

* cited by examiner

*Primary Examiner*—Jennifer H. Gay
*Assistant Examiner*—Christopher Boswell
(74) *Attorney, Agent, or Firm*—The Nath Law Group; Jerald L. Meyer; Derek Richmond

(57) ABSTRACT

A mechanism for an electro-mechanical lock. The mechanism comprises a shackle or strike moveable in a bore. A cam is rotatable between a first cam position in which movement of the shackle or strike in the bore is prevented and a second cam position in which movement of the shackle or strike in the bore is not prevented. A blocking pin is moveable between a first pin position in which rotation of the cam is prevented and a second position in which rotation of the cam is not prevented. A solenoid has a plunger having a stable extended position in which movement of the blocking pin is prevented and a stable retracted position in which movement of the blocking pin is not prevented.

12 Claims, 6 Drawing Sheets

(a)
Locked (b)
Unlocked (c)
Cocked (a)

(b)

ELECTRONIC LOCKING MECHANISM AND LOCK CONTAINING IT

FIELD OF THE INVENTION

This invention relates to electronic locks, and more specifically to electronic locks having a solenoid servomechanism.

BACKGROUND OF THE INVENTION

Electronic locks use an electrical servomechanism to reversibly block locking or unlocking. In some locks, the plunger of the solenoid functions as the bolt or latch of the lock. In other locks, the plunger is configured to reversibly prevent the movement of a separate bolt or latch. In either case, the plunger performs a linear movement or rotation under the influence of electromagnetic forces and elastic elements.

SUMMARY OF THE INVENTION

The present invention provides an electronic locking mechanism. In accordance with the invention, the locking mechanism includes a cam that is rotatable in a cylindrical bore. Insertion or removal of a shackle or strike from the lock is coupled with rotation of the cam. In a locked configuration of the mechanism, a blocking pin prevents rotation of the cam, and hence removal of the shackle or strike. In an unlocked configuration, rotation of the cam is not prevented, thus allowing removal of the shackle or strike.

In a lock having the mechanism of the invention, the need for a micro-switch to detect the presence of the shackle is eliminated. Thus, when the lock is in an unlocked state, the mechanism may enter a stand-by mode that consumes little electricity. Furthermore, when the plunger of the solenoid moves between its extended and retracted positions, it does not experience friction from other components of the locking mechanism. This reduces the size of the solenoid that may be used. The mechanism may be brought into the locked state just by inserting the shackle or strike, without use of a key or code.

The invention thus provides a mechanism for an electro-mechanical lock comprising:

a shackle or strike moveable in a bore;

a cam rotatable between a first cam position in which movement of the shackle or strike in the bore is prevented and a second cam position in which movement of the shackle or strike in the bore is not prevented;

a blocking pin moveable between a first pin position in which rotation of the cam is prevented and a second position in which rotation of the cam is not prevented; and a solenoid having a plunger having a stable extended position in which movement of the blocking pin is prevented and a stable retracted position in which movement of the blocking pin is not prevented.

The invention further comprises an electro-mechanical lock comprising the mechanism of the invention. The lock may be, for example, a padlock, door lock, or drawer lock.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF THE INVENTION

Figure 1:
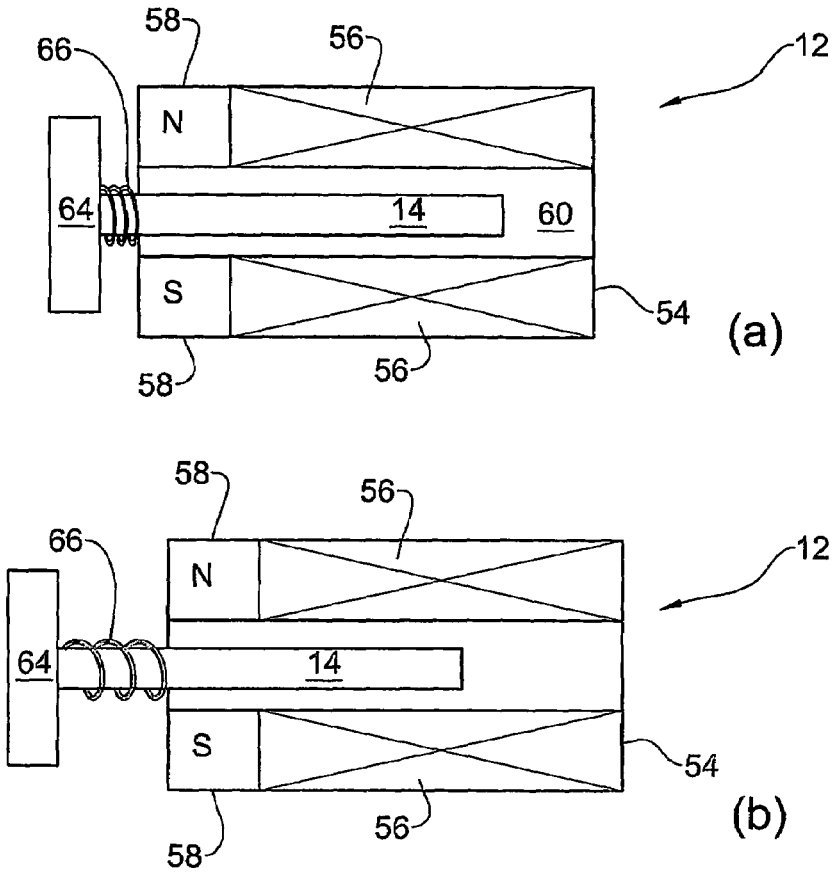
FIG. 1 shows a solenoid for use in an electronic locking mechanism.

FIG. 1 shows the structure of a solenoid 12 that may be used in the lock mechanism of the present invention. The solenoid 12 comprises a housing 54 with an electromagnetic coil 56 and a permanent magnet 58 formed within a cylindrical bore 60. A compression spring 66 urges the plunger 14 away from the magnet 58. The plunger 14 has two stable states: a retracted state with the head 64 close to the magnet 58 and the spring 66 compressed (shown in FIG. 1*a*), and an extended state with the head 64 urged away from the magnet (shown in FIG. 1*b*).

Activation of the solenoid 12 to bring the plunger 14 from its extended position in the retracted position, may be any means known in the art for activating an electronic lock. For example, the solenoid 12 may be activated by means of a key, or by inputting a numeric code into a keyboard associated with the lock. Alternatively, a coded series of impacts may be delivered by a hand-held electronically programmed impacting device.

Figure 2:
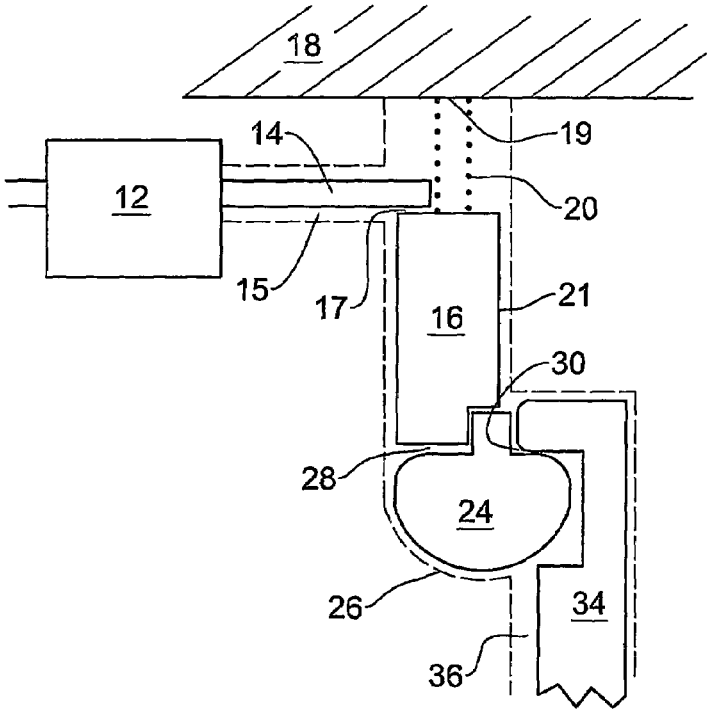
FIG. 2 shows an electronic locking mechanism in accordance with one embodiment of the invention.
Figure 2:
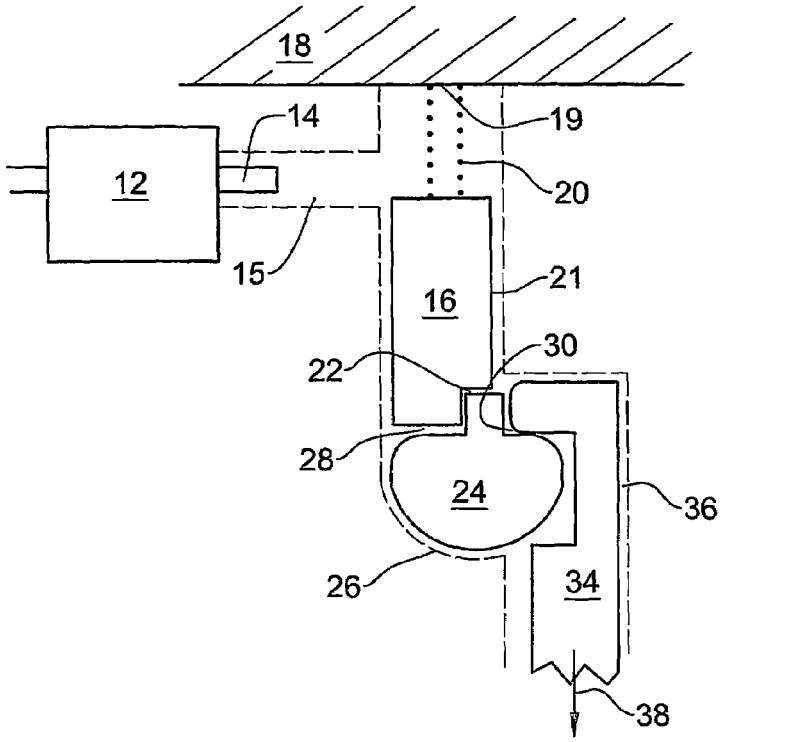
Figure 2:
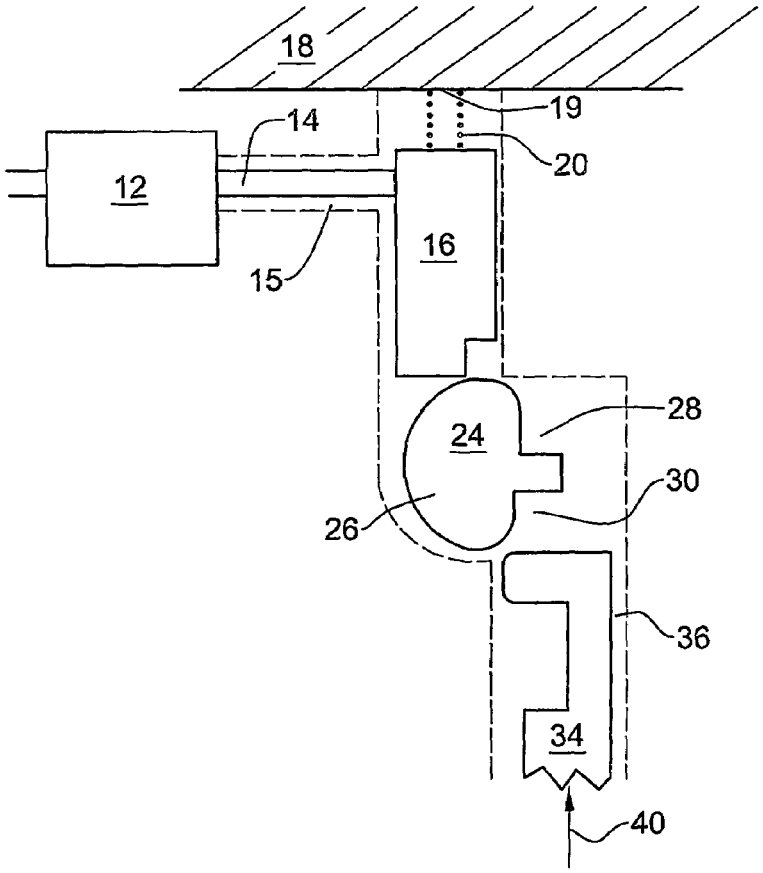

FIG. 2 shows schematically a locking mechanism 10 in accordance with the invention for use in an electronic lock. In the mechanism 10, a latched solenoid 12 has a plunger 14 that moves in a bore 15 between a stable extended state shown in FIG. 2*a*, and a stable retracted state shown in FIG. 2*b*. A blocking pin 16 is attached at one end to an attachment site 19 on housing 18 of the lock by a spring 20. The spring 20 biases the blocking pin 16 away from the attachment site 19 in a bore 21. The blocking pin 16 has a notch 22 at another end. A cam 24 is rotatable in a cylindrical bore 26. The cam 24 has, at one or more points along its length, a pair of notches consisting of a first notch 28 and a second notch 30.

FIG. 2*a* shows the mechanism in a locked configuration. In this configuration, the cam 24 engages a shackle or strike 34 located in a cylindrical bore 36. The plunger 14 is latched in an extended state. The spring 20 is in an extended state. Movement of the blocking pin 16 towards the attachment site 19 is prevented by the plunger 14. The blocking pin 16 in its position shown in FIG. 2*a* prevents rotation of the cam 24, which in turn prevents movement of the shackle or strike 34 in the bore 36.

FIG. 2*b* shows the mechanism 10 in an unlocked configuration. In this configuration, the plunger is in its retracted position. Movement of the shackle or strike 34 in the bore 36 in the direction of the arrow 38 rotates the cam 24 in a clockwise direction. Rotation of the cam 24 pushes the blocking pin 16 towards the attachment site 19 against the spring 20, as shown in FIG. 2*c*.

The mechanism 10 is programmed to automatically return the plunger to its extended at a predetermined time (e.g. 6 sec) after its retraction. If the shackle or strike 34 has been removed from the bore 36 during this time interval, the mechanism 10 enters a meta-stable "cocked" state shown in FIG. 2*c*, in which the plunger 24 is between its retracted and extended states and presses against the blocking pin 16. The cam 24 prevents movement of the blocking pin 16 away from the housing 18. If the shackle or strike 34 has not been removed during this time interval, the mechanism returns to the locked state shown in FIG. 2*a*.

With the mechanism 10 in the cocked state as shown in FIG. 2*c*, insertion of the shackle or strike 34 into the bore in the direction of the arrow 40 will bring the mechanism 10 into the locked configuration shown in FIG. 2*a*. Insertion of the shackle or strike 34 in the bore 36 causes the cam 24 to rotate counter clockwise, allowing the blocking pin 16 to move away from the housing 18 under the influence of the spring 20. Movement of the plunger 14 is no longer obstructed by the blocking pin 16, so that the plunger 14 assumes its extended position shown in FIG. 2*a*. The mechanism may thus be brought into the locked state just by inserting the shackle or strike 34 into the bore 36, without use of a key or code. The shackle or strike 34 need only be inserted into the bore 36 just enough to rotate the cam 24 counter clockwise about ⅛ of a turn in order to cause the blocking pin 16 to move away from the attachment site 19. This movement of the blocking pin 16 will cause the cam 24 to rotate further to the position shown in FIG. 2*a*, which, in turn, will draw the shackle or strike 34 further in the direction of arrow 40 so as to engage the shackle or strike 34 as shown in FIG. 2*a*.

With the mechanism of the invention, there is no need for a micro-switch to detect the presence of the shackle or strike 34 in the bore 36. Thus, in the cocked state shown in FIG. 2*c* or the locked state shown in FIG. 2*a*, the electronics is in a stand-by mode that consumes little electricity. When the blocking pin 16 is in its position shown in FIG. 2*a*, there is a space 17 between the plunger 14 and the blocking pin 16, so that the plunger 14 does not experience any friction from the blocking pin 16 when the plunger 14 moves between its extended and retracted states. This reduces the size of the solenoid 12 that must be used.

Figure 3:
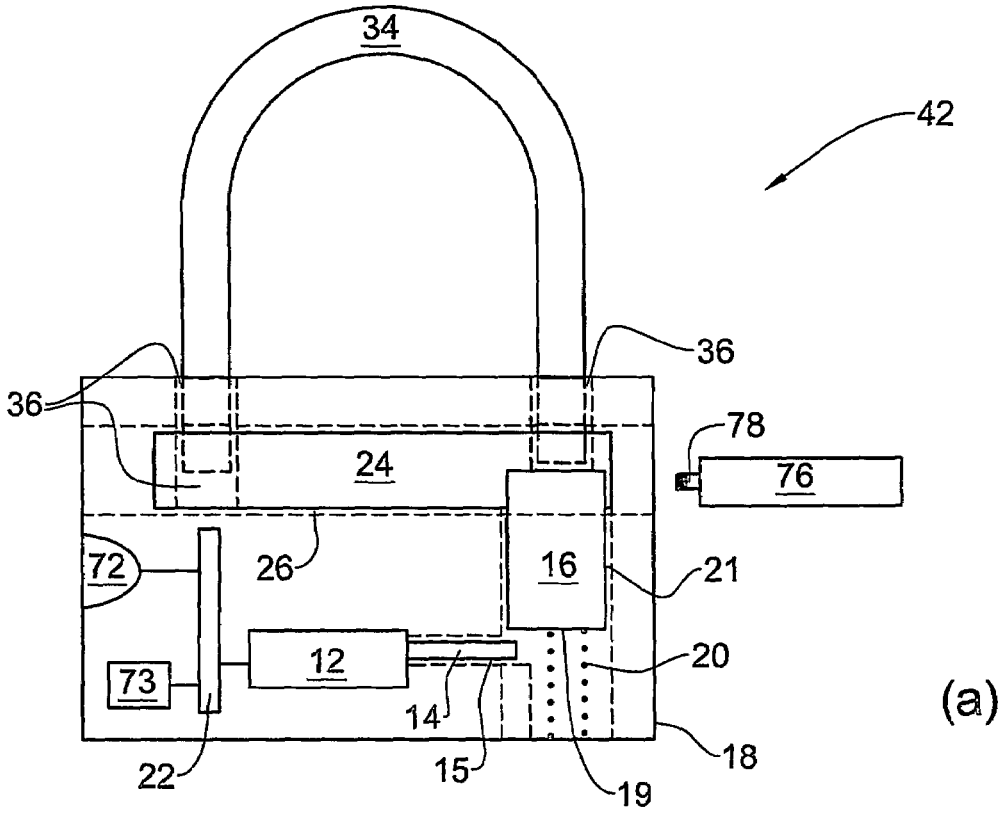
FIG. 3 shows a padlock containing a locking mechanism in accordance with one embodiment of the invention.
Figure 3:
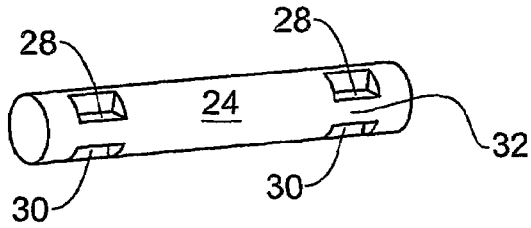
Figure 3:
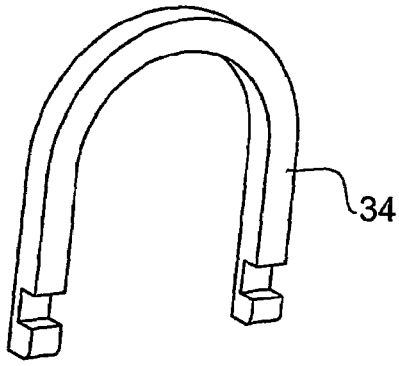

FIG. 3*a* shows a padlock 42 comprising the mechanism 10 of the invention that is unlocked by delivering to it a coded series of impacts. The padlock 42 has a U-shaped shackle 34 (shown separately in FIG. 3*c*) that is received in two cylindrical bores 36. The cam 24, shown separately in FIG. 3*b*, has two pairs of first and second notches 28 and 30, respectively. The padlock 42 has an electronic circuit including a battery 73, an impact sensitive microphone 72, and a programmable controller 22 with memory. The controller is adapted to decode signals received by the microphone and to compare them to a lock access code stored in the memory.

The padlock 42 has an associated impact generating electronic key 76, which is a hand-held programmable data-transmitting device. The key includes an impact head 78 using, for example, electromagnetic, piezoelectric or magnetostriction effect. The key 76 further comprises a programmable controller with memory, and a battery. The key 76 is designed to produce a coded series of pulse-like, high-energy impacts of the impact head 78, in accordance with a key access code stored in the memory. Methods of coding a series of impacts are described in U.S. Pat. No. 6,411,195, included herein by reference. The key may have a numeric keypad for programming the key access code or, alternatively, the access code may be programmed in a special device.

In order to unlock the padlock 42, the key 76 is urged by hand to any point of the housing 18. A key access code (a number) is input via the keypad and a corresponding series of impacts is delivered by the impact head 78 to the surface of the housing 18. Alternatively, the key access code may be pre-programmed in the memory or pre-dialed, in which case a coded series of impacts may be initiated by pressing a single button on the key. The microphone 72 picks up vibrations inside the padlock resulting from the impacts. The vibrations are suitably processed and decoded by the controller 22, and are then compared to the lock access code programmed in the memory of the controller 22. Upon successful match, the controller 22 energizes the coil 56 of the solenoid 12, overcoming the action of the spring 66. When the head 64 of the plunger 14 approaches the magnet 58, the magnet 58 latches the plunger 14 in its retracted state in which the cam 24 is free to rotate in the bore 26. The shackle or strike 34 can now be removed by hand.

Figure 4:
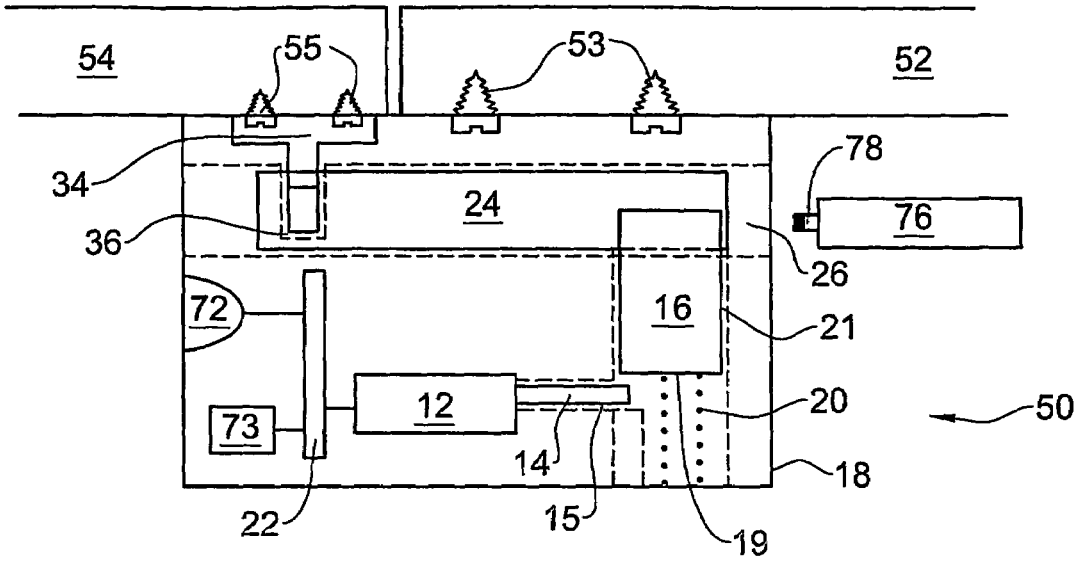
FIG. 4 shows a door lock containing a locking mechanism in accordance with one embodiment of the invention.
Figure 4:
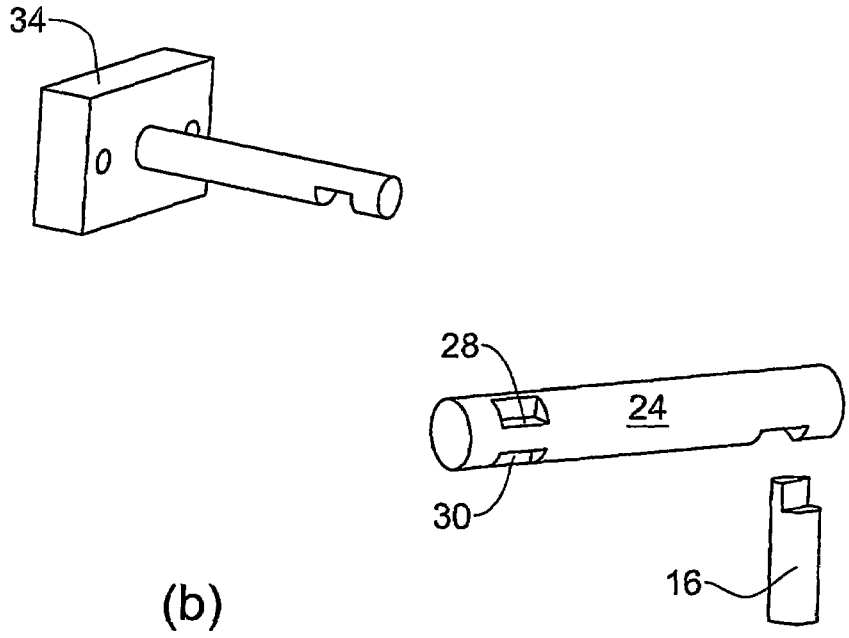

FIG. 4*a* shows a door lock 50 comprising the mechanism 10. The door lock 50 has components in common with the padlock 42, and similar components are indicated by the same numeral. In the door lock 50, the housing 18 is securely fixed onto a door 52 for example, by means of screws 53. The strike 34 is similarly fixed onto an adjacent doorframe or wall 54 by screws 55. The strike 34, cam 24 and blocking pin 16 are shown separately in FIG. 4*b*. Operation of the door lock 50 is the same as that of the padlock 42. The door lock 50 may be opened by delivering a coded sequence of impacts by the key 76 to either side of the door 52.

Figure 5:
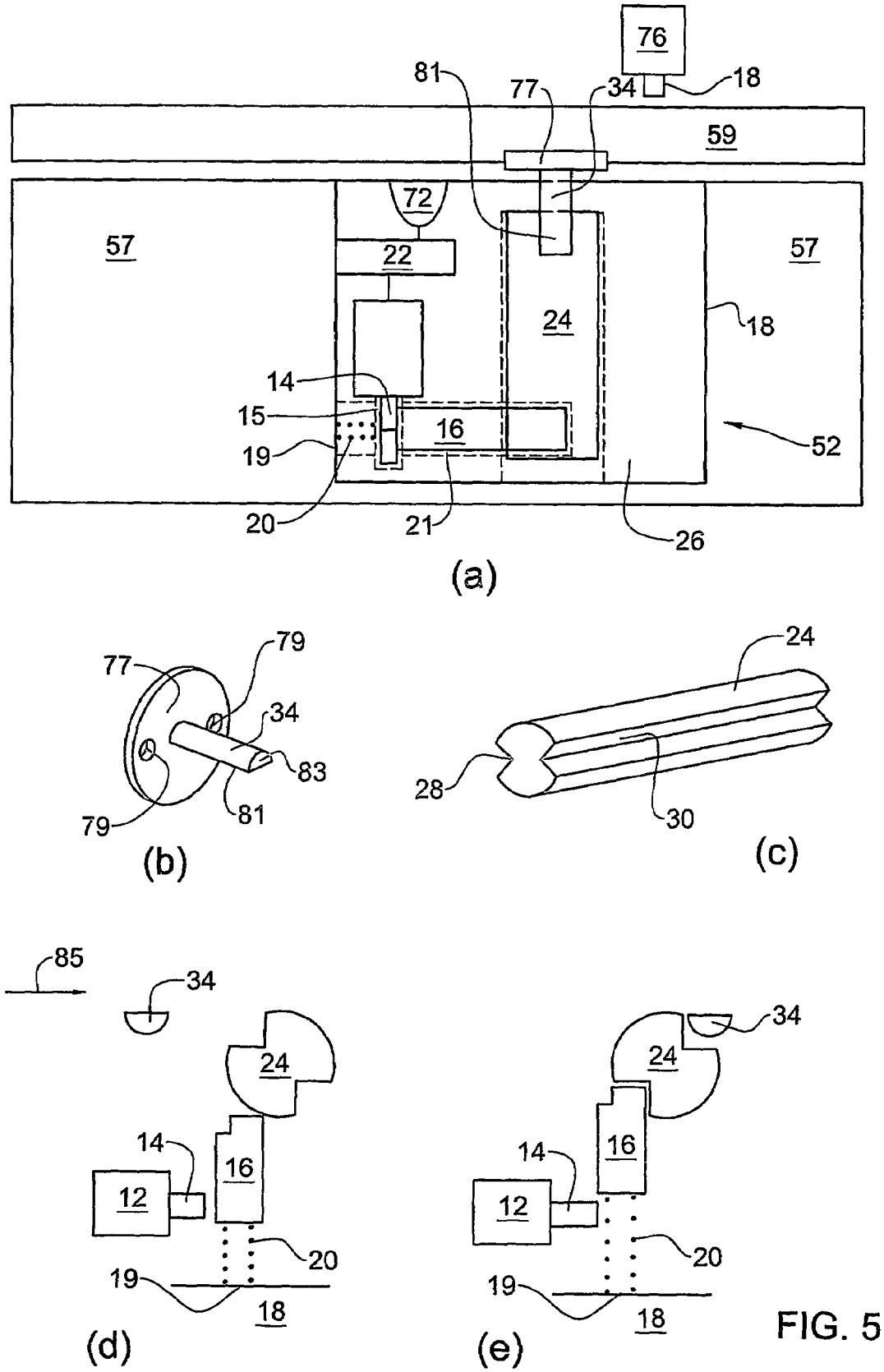
FIG. 5 shows a drawer lock containing a locking mechanism in accordance with one embodiment of the invention.

FIG. 5*a* shows a drawer lock 54 comprising the mechanism 10. The drawer lock 57 has components in common with the padlock 42 and the door lock 50, and similar components are indicated by the same numeral. In the drawer lock 52, the housing 18 is securely fixed onto front drawer panel 57 by means of screws (not shown) and the strike 34 is fixed onto the drawer frame 59. FIG. 5*b* shows separately the strike 34. The strike 34 has a base plate 77 with two screw holes 79. The portion 81 of the strike 34 projecting from the base plate 77 has a semicircular cross-section 83. FIG. 5*c* shows separately the cam 24. It has first and second grooves 28 and 30 that are diametrically opposite one another. FIG. 5*d* shows the relationship between the solenoid 12, cam 24 and the blocking pin 16 when the locking mechanism is in the cocked state. During locking, the strike 34 is urged towards the cam 24 in the direction of the arrow 85. This causes the cam 24 to rotate clockwise, so as to bring the mechanism into the locked state, as shown in FIG. 5*e*. The drawer lock 54 may be opened by delivering a coded sequence of impacts by the key 76 the front panel 56 of the drawer.

Figure 6:
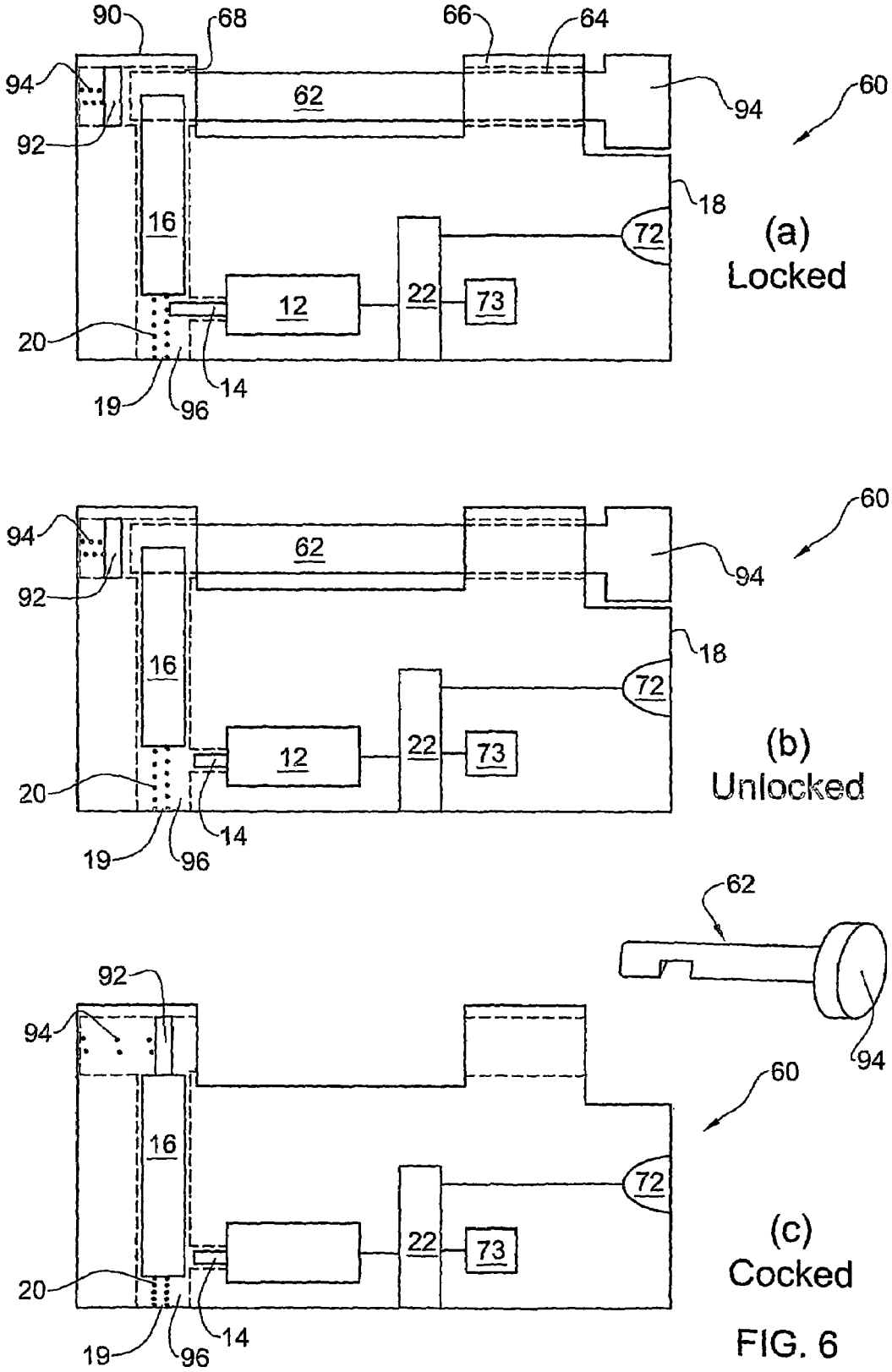
FIG. 6 shows another padlock containing a locking mechanism in accordance with one embodiment of the invention.

FIG. 6 shows a second padlock 60 comprising the mechanism 10 having a U shaped housing 18. The padlock 60 has components in common with the draw lock 54 the padlock 42 and the door lock 50, and similar components are indicated by the same numeral. The padlock 60 has a U shaped housing 18. The cam and the shackle are integrated into a single component referred to as shackle 62. The bore 36 consists of a through portion 64 passing though the arm 66 of the housing 18, and a blind bore portion 68 in the arm 90 of the housing 18. The padlock 60 further includes a dummy plug 92 at the end of the blind bore 68. The shackle 62 is slidingly and rotatably disposed in the bore 36.

FIG. 6*a* shows the padlock 60 in its locked state, and FIG. 6*b* shows the padlock 60 in its unlocked state. The shackle 62 is now rotated by hand using the handle 94. Rotating the shackle 62 causes the blocking pin 16 to move towards the attachment site 19. The shackle 62 can then be removed from the bore 36. As the shackle is removed from the blind bore 68, the dummy plug 92 is urged by the spring 94 over the bore 96 to prevent the blocking pin 16 from entering the bore 68. In FIG. 6*c*, the lock is in its cocked state.

In order to lock the lock 60, the shackle 62 is inserted into the through bore 64 and into the blind bore 68, pushing the dummy plug 92 out of the blind bore 68. The blocking pin 16 is then urged into the blind bore 68 by the spring 20 so as to engage the shackle 62.

The invention claimed is:

1. A mechanism for an electro-mechanical lock comprising:

a shackle or strike moveable in a bore;

a cam rotatable between a first cam position in which the shackle or strike may be immobilized in the bore and a second cam position;

a blocking pin moveable between a first pin position in which rotation of the cam is prevented and a second pin position in which rotation of the cam is not prevented, the blocking pin being spring biased into the first pin position;

a solenoid having a plunger with a stable extended position in which movement of the blocking pin from the first pin position to the second pin position is prevented and with a stable retracted position in which movement of the blocking pin is not prevented, wherein, when the solenoid is brought to its retracted position, the cam can rotate from its first position towards its second position as the shackle or strike is removed from the bore, causing the blocking pin to move from its first position to its second position, and wherein, when the solenoid plunger is cocked against the blocking pin, insertion of the shackle or strike into the bore causes the cam to rotate from its second position towards its first position, so as to immobilize the shackle or strike in the bore allowing the blocking pin to assume its first position, and allowing the solenoid to assume its extended position.

2. The mechanism according to claim 1 wherein the solenoid plunger becomes cocked against the blocking pin following a predetermined amount of time after the solenoid was brought to its retracted position.

3. The mechanism according to claim 1 wherein whereupon rotation of the cam from its second position to its first position upon insertion of the shackle or strike into the bore, the spring biased blocking pin causes the cam to rotate to its first position.

4. The mechanism according to claim 1 further comprising:

an impact sensitive microphone;

a controller configured to decode signals received by the microphone and to compare the decoded signals stored in a memory and to activate the solenoid upon a successful match between the decoded signals and the signals stored in the memory; and an impact generating electric key configured to produce a coded series of impacts to the mechanism.

5. An electro-mechanical lock comprising the mechanism according to claim 1.

6. The lock according to claim 5 being a padlock, door lock or draw lock.

7. A padlock according to claim 6 wherein the cam and the shackle are integrated into a single component.

8. The padlock according to claim 7 further comprising a dummy plug preventing movement of the blocking pin into the bore upon removal of the shackle from the bore.

9. An electromechanical lock, comprising:

a solenoid having a plunger with a stable retracted and a stable extended states; a blocking pin linearly movable between first and second pin positions the movement thereof being blocked by the plunger when in said first pin position and the plunger is in said extended state; a rotatable cam rotatable between first second cam positions and being blocked from rotation when the blocking pin is in said first pin position; and a shackle or strike movable in a shackle bore between an extracted and a retracted position in which it engages the cam, movement from one position to another and back causes rotation of the cam into opposite directions; and the lock having a locked state and an unlocked state; in the locked state the cam engages the shackle or strike, the blocking pin engages the cam to prevent its rotation and the plunger is in its extended state preventing linear movement of the blocking pin; and in the unlocked state, the solenoid is activated to move the plunger to its retracted state, whereby the blocking pin can move to said second pin position upon rotation of the cam as a result of moving the shackle or strike from the retracted to the extracted position.

10. A lock according to claim 9, comprising:

an impact sensitive microphone;

an impact generating element configured to produce a coded series of impacts; and a controller configured to receive signals from the microphone generated in response to said impacts, and upon identifying a coded series signals activating the solenoid to move said plunger from the extended to the retracted state.

11. A lock according to claim 9 or 10, wherein a controller of the solenoid causes the solenoid to retain the plunger in the retracted state for a predetermined time period.

12. A lock according to claim 9, being a padlock, door lock or draw lock.

* * * * *